US009963252B2

(12) United States Patent
Baumert et al.

(10) Patent No.: US 9,963,252 B2
(45) Date of Patent: May 8, 2018

(54) DEVICE FOR PACKAGING A WIPER BLADE

(71) Applicant: Robert Bosch GmbH, Stuttgart (DE)

(72) Inventors: Stefan Baumert, Karlsruhe (DE); Ruediger Renner, Pfinztal-Berghausen (DE)

(73) Assignee: ROBERT BOSCH GMBH, Stuttgart (DE)

( * ) Notice: Subject to any disclaimer, the term of this patent is extended or adjusted under 35 U.S.C. 154(b) by 321 days.

(21) Appl. No.: 14/349,909

(22) PCT Filed: Sep. 20, 2012

(86) PCT No.: PCT/EP2012/068519

§ 371 (c)(1),
(2) Date: Apr. 4, 2014

(87) PCT Pub. No.: WO2013/050251

PCT Pub. Date: Apr. 11, 2013

(65) Prior Publication Data

US 2014/0250841 A1 Sep. 11, 2014

(30) Foreign Application Priority Data

Oct. 4, 2011 (DE) ..... 10 2011 083 955

(51) Int. Cl.
*B65D 5/50* (2006.01)
*B65B 1/02* (2006.01)

(52) U.S. Cl.
CPC ..... *B65B 1/02* (2013.01); *B65D 5/5069* (2013.01); *B65D 2585/6885* (2013.01)

(58) Field of Classification Search
CPC ..... B65D 2585/6885; B65D 5/5069
(Continued)

(56) References Cited

U.S. PATENT DOCUMENTS 3,381,807 A * 5/1968 De Vaughn ..... B65D 59/06 206/363
4,239,104 A * 12/1980 Roccaforte ..... B65D 65/12 206/335

(Continued)

FOREIGN PATENT DOCUMENTS

CN 101092131 12/2007
DE 19829125 1/2000

(Continued)

OTHER PUBLICATIONS

International Search Report for PCT/EP2012/068519, dated Dec. 10, 2012.

*Primary Examiner* — Steven A Reynolds
(74) *Attorney, Agent, or Firm* — Norton Rose Fulbright US LLP; Gerard Messina

(57) ABSTRACT

A device for packaging a wiper blade for a windshield wiping system of a motor vehicle including a flexurally stiff container as well as at least one insert, which is able to be inserted into the container together with the wiper blade. The device includes at least two inserts, developed essentially having mirror symmetry, for accommodating each of an end section of the wiper blade, each insert having at least one accommodation region for accommodating a spring-elastic carrier element and/or a wiper lip of the wiper blade, an accommodation region provided for accommodating the wiper lip being oversized compared to the dimensions of the wiper lip, so that the wiper lip is able to be accommodated in such a way that a sensitive wiping edge of the wiper lip has no contact with the insert.

8 Claims, 2 Drawing Sheets

(58) Field of Classification Search
USPC ..... 206/349, 470, 335
See application file for complete search history.

(56) References Cited

U.S. PATENT DOCUMENTS 5,178,279 A * 1/1993 Carroll ..... B65D 5/5088 206/335
6,041,933 A * 3/2000 Baker ..... B65D 25/10 206/335
2006/0081493 A1* 4/2006 Park ..... B65D 25/10 206/470
2006/0163096 A1* 7/2006 Reiber ..... B60S 1/3848 206/349
2007/0235362 A1* 10/2007 Lewis ..... B65D 43/162 206/470
2009/0025174 A1* 1/2009 Braun ..... B60S 1/381 15/250.48
2009/0049638 A1* 2/2009 Jehannet ..... B60S 1/3848 15/250.32
2010/0230426 A1* 9/2010 Ku ..... B60S 1/38 220/735
2012/0111858 A1* 5/2012 Lewis ..... B65D 77/26 220/4.23
2013/0105343 A1* 5/2013 Bult ..... B65D 75/22 206/349
2013/0327665 A1* 12/2013 Jehannet ..... B65D 85/54 206/372
2014/0360914 A1* 12/2014 Denney ..... B65D 81/058 206/583

FOREIGN PATENT DOCUMENTS

DE 10224431 12/2003
FR 2875486 3/2006
WO WO2010/037541 4/2010

* cited by examiner

DEVICE FOR PACKAGING A WIPER BLADE

FIELD OF THE INVENTION

The present invention relates to a device for packaging a wiper blade for a windshield wiping system of a motor vehicle. Such a device is developed in several parts, and includes a flexurally stiff container and at least one insert which is able to be inserted into the container together with the wiper blade.

BACKGROUND INFORMATION

A packaging device of the type mentioned at the outset is known from German Published Patent Appln. No. 102 24 431, for example. It includes a folding box as the flexurally stiff container and an insert which is inserted into the container after accommodating at least one wiper blade. The dimensions of the folding box and the container are selected so that the wiper blade accommodated in the insert, and curved in the unloaded state is stretched out in response to the insert being introduced into the folding box. In order to prevent the wiper blade from suddenly releasing its tension when taken out of the folding box, the insert is made of a material whose flexural stiffness in the direction of curvature of the wiper blade is lower than that of the wiper blade, so that, when the insert is pulled out of the folding box, the stretched wiper blade bends back steadily into its curved form. The insert preferably has at least one accommodation in which the wiper blade is at least partially able to be accommodated with form-locking. For the protection of a wiper lip of the wiper blade, the insert is preferably further developed in such a way that the wiper lip is enclosed completely when the wiper blade is inserted. To protect the end faces of the wiper lip in the longitudinal direction, the insert has a greater linear dimension than the stretched wiper blade.

Starting from the abovementioned related art, the present invention is based on the object of stating a packaging device for at least one wiper blade, which assures a sufficient protection of the wiper lip and at the same time is able to be produced cost-effectively.

SUMMARY

Besides a flexurally stiff container, the device provided for packaging a wiper blade includes at least two inserts developed essentially with mirror symmetry so that each accommodates an end section of the wiper blade and which, together with the wiper blade, is able to be inserted in the container. Moreover, according to the present invention, each insert has at least one accommodation region for accommodating a spring-elastic carrier element and/or a wiper lip of the wiper blade, an accommodation region provided for accommodating the wiper lip having an oversize compared to the dimensions of the wiper lip, so that the wiper lip is able to be accommodated in such a way that the sensitive wiper edge of the wiper lip does not make contact with the insert.

Since the inserts only have to accommodate one more end section of a wiper blade, their dimensions may be clearly reduced, particularly in the longitudinal direction. Although, in contrast to the related art described at the outset, a plurality of inserts are provided, packaging material may clearly be saved in this way, and costs reduced thereby. The essentially mirror-symmetrical design of the inserts also simplifies their production, whereby costs are further reduced.

The inserts provided for accommodating the end sections of the wiper blades are additionally capable of assuring sufficient supporting of the wiper blade when it is inserted in the flexurally stiff container. The support takes place in such a manner that, in response to the stretching of the wiper blade provided, the sensitive wiper lip remains unstressed. To effect the stretching of the wiper blade, the dimension of the flexurally stiff container in the direction of curvature of the wiper blade is selected to be smaller than that of the wiper blade in the unstressed state. When the wiper blade is inserted, it is then stretched automatically, it being supported via the two inserts placed on at the end at a first inner side of the container and via a contact area at the summit of the curvature on a second inner side of the container opposite the first inner side. Since the sensitive wiper lip of the wiper blade comes to lie at the summit of the curvature, it remains unstressed except for the stretching. The contact area in the summit of the curvature may accordingly be developed on the wiper blade itself. That being the case, the number of inserts may be reduced to two inserts for accommodating the respective end sections of the wiper blade.

In the area of the two end sections of the wiper blade, the wiper lip gets to lie outside, so that, without the inserts according to the present invention, the wiper lip would lie directly on the inside of the container, and the wiper blade would support itself on the inside, via the wiper lip. In that situation, the sensitive wiper edge of the wiper lip could suffer damage. The important thing is to prevent this. Accordingly, the inserts according to the present invention each have at least one accommodation range which, compared to the dimensions of the wiper lip, are oversized in the area of the end sections of the wiper blade that are to be accommodated. Therefore the wiper lip lies in an exposed manner, and also remains to a great extent unstressed in response to the stretching of the wiper blade. For this purpose, it is important to ensure that at least the wiping edge of the wiper lip touches the insert neither in the stress-relieved nor in the stretched state. Preferably, however, the wiper lip is accommodated in such a way in the accommodation region of the insert, that it lies exposed on three sides, the wiping edge as well as the two side edges adjacent to it. A stressing of the wiper lip then still takes place only via the stretching itself.

It is further proposed that an accommodation region, provided for accommodating the spring-elastic carrier element, of an insert in the form of the spring-elastic carrier element is adapted, in the region of the end section of the wiper blade that is to be accommodated, so that by inserting the wiper blade into the insert, form-locking is able to be effected in at least one direction. Form-locking should preferably be effected at least in the direction of curvature, so that the wiper blade is fixed in position in the direction of curvature. It is thereby ensured that the wiper blade is supported on the insert(s) during stretching via the spring-elastic carrier element, and the wiper lip continues to remain stress-free.

Alternatively, one may also do without an additional accommodation region for accommodating the spring-elastic carrier element, if the position fixing of the wiper blade within the insert in the direction of curvature is assured in a different manner.

According to one preferred specific embodiment of the present invention, the inserts each include an upper and a lower part, which are able to be connected by force-locking and/or by form-locking. The at least two-part execution of an insert simplifies the connection of the insert to the wiper blade. The wiper blade is first laid into one of the parts, and after that the respectively other part is connected to the former. The upper and the lower part are preferably developed essentially with mirror symmetry, so that an insert composed of these parts is able to be connected to any end section of the wiper blade. In this manner, the production costs are able to be reduced further.

As a further developing measure it is provided that the upper and the lower part each have at least one connecting arrangement for the force-locking and/or form-locking connection. The connecting arrangement may include, for example, a latch on the first part and a recess for the latching accommodation of the latch on the other part. Beyond that, all other connecting arrangement may be used which enable a force-locking and/or a form-locking connection. The connection works counter to a position change of the two parts with respect to each other when the wiper blade is inserted with the insert into the flexurally stiff container.

It is further provide that the upper and the lower part be developed as one piece and/or hinged. This has the advantage that the one part is held on the other part respectively, safe from being lost. The hinged connection also makes possible tilting the two parts with respect to each other, so as to be able to put the two parts together, after inserting the wiper blade, in such a way that they encompass the wiper blade. The two parts may then be connected to each other and fixed in their positions via the preferably provided connecting arrangement. The hinge is preferably developed as a film hinge, and is made up of the same material as the two parts.

According to one preferred specific embodiment of the packaging device according to the present invention, the inserts are made of a plastic and/or produced by a deep-drawing method. The inserts are able to be produced especially cost-effectively in this manner. In addition, the development of a film hinge is made more simply.

The flexurally stiff containers into which the inserts are inserted having the wiper blade may also be developed as one or more parts, and made of a plastic. As an alternative material for the development of the flexurally stiff container, cardboard is a possibility. In the case of a multi-part execution of the flexurally stiff container, different materials, such as plastic and cardboard may also be combined. For instance, a container that is open on one side, made of plastic, may be closed, after the insertion of the wiper blade, inclusive of the inserts, using a back cover made of cardboard. The back cover may be connected, for this purpose, to the container made of plastic by adhesion, bonding and/or in a form-locking manner. The back cover may also function as an information carrier, and have printing on it at least on the outside.

In order to enable the insertion of the wiper blade including the inserts, the flexurally stiff container is furthermore preferably open or able to be opened on at least one end face or longitudinal side.

If in a flexurally stiff container, more than one wiper blade, for instance a pair of wiper blades, is to be accommodated, it is further provided that the inserts each have a plurality of first and second accommodation regions, the number of the first and second accommodation regions each corresponding to the number of wiper blades that are to be accommodated. Besides first and second accommodation regions, additional accommodation regions may be provided as a function of the respective design of an end section of the wiper blade to be accommodated, which are used, for instance, to accommodate possible spoilers situated on the spring-elastic carrier element or other support structures.

DETAILED DESCRIPTION

Figure 1:
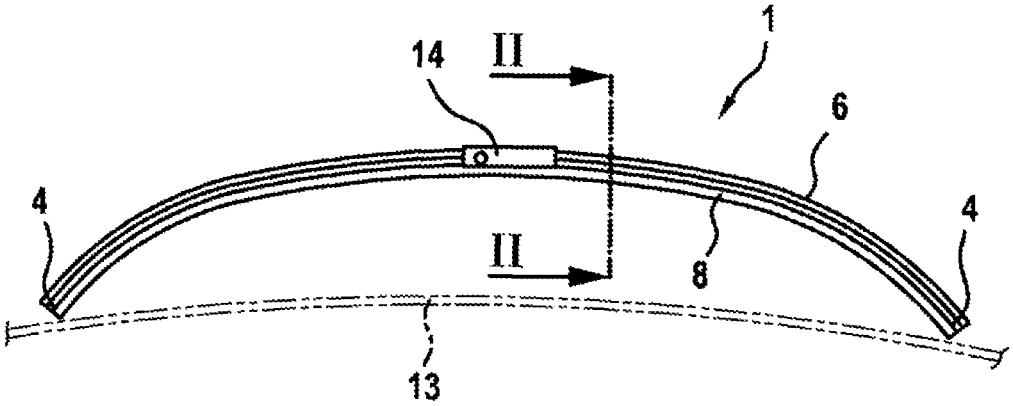
FIG. 1 shows a side view of a wiper blade.

In the simplified illustration of FIG. 1, one may see a wiper blade 1 which is to be packaged in the device according to the present invention. In the unstressed state, wiper blade 1 has a curvature that is supposed to ensure the secure engagement of wiper blade 1 on a vehicle pane 13, when wiper blade 1 is pressed against pane 13. For this purpose, wiper blade 1 is able to be connected via an adapter 14 to a windshield wiper arm of a windshield wiper system of the vehicle. In the present instance, adapter 14 is situated centrically with respect to the length of wiper blade 1, so that the distance to the two end sections 4 of wiper blade 1 is the same.

Figure 2:
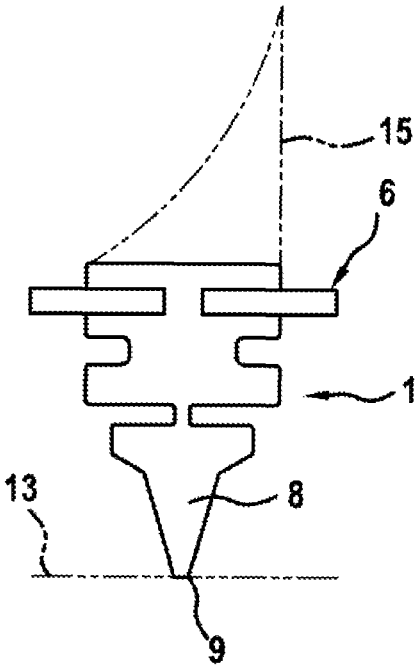
FIG. 2 shows a cross-section through a wiper blade.

The cross section of wiper blade 1 shown in FIG. 1 could approximate that of FIG. 2. However, other cross sections are also possible, which cannot all be drawn up in this instance. Wiper blade 1 of FIG. 2 has a flat, prebent spring-elastic carrier element 6, which in the present case is connected with form-locking to a wiper lip 8, and, in this manner, effects the curvature of wiper blade 1 (see FIG. 1). Instead of a form-locking connection, the connection of carrier element 6 to wiper lip 8 may also be produced in another manner, Wiper lip 8 is profiled and tapers in the direction of a wiping edge 9, using which wiper lip 8 lies against pane 13. The profiling is intended to ensure the flexibility of wiper lip 8. Furthermore, a wind strip in the form of a spoiler 15 may be situated on wiper lip 8 or on spring-elastic carrier element 6.

Figure 3:
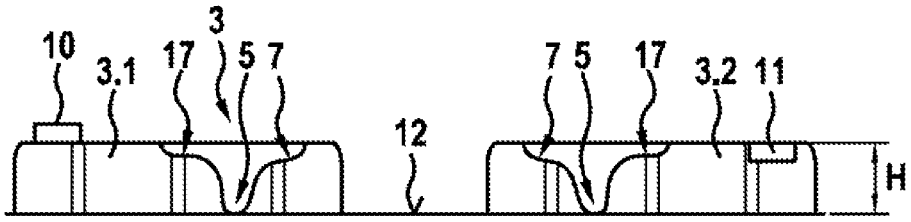
FIG. 3 shows a side view of an insert.
Figure 4:
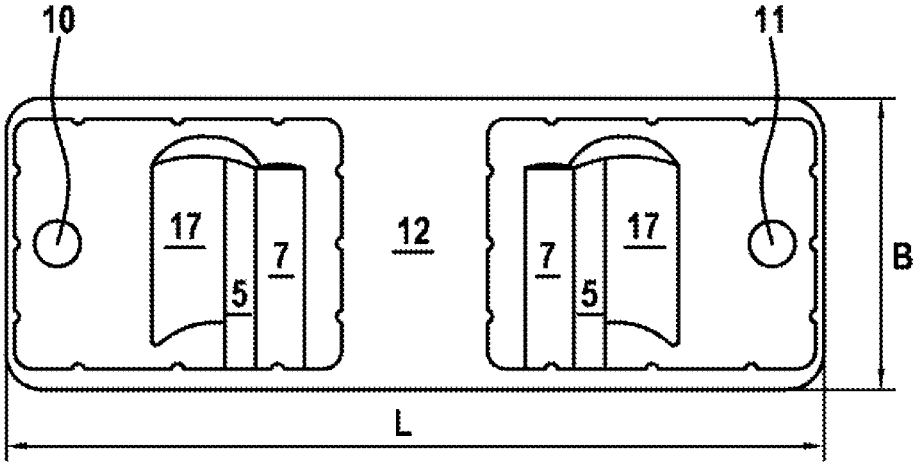
FIG. 4 shows a top view of an insert.
Figure 5:
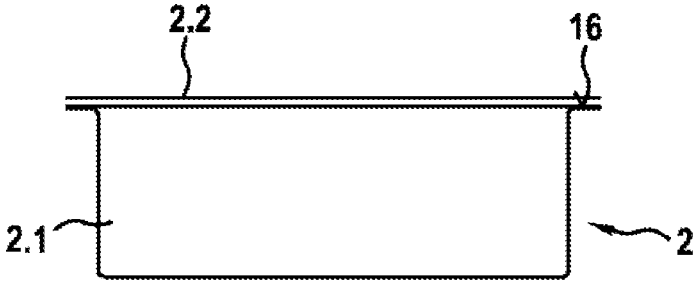
FIG. 5 shows a side view of a flexurally stiff container.

In order to protect sensitive wiper lip 8 of a comparable wiper blade 1 before its being mounted on the vehicle, the packaging device according to the present invention is provided, which includes a flexurally stiff container 2 (see FIG. 5) and at least two inserts 3 (see FIGS. 3 and 4). Flexurally stiff container 2 is presently executed in two parts, a first part 2.1, that is open on one side, being made of a transparent plastic, and a second part 2.2 made of cardboard being provided for closing the opening of first part 2.1. In order to connect the two parts 2.1, 2.2, the opening of first part 2.1 is bordered by an encircling flange 16, on which the second part made of cardboard is applied in laminated fashion after the insertion of wiper blade 1.

The dimensions of flexurally stiff container 2 are selected so that wiper blade 1 is stretched when it is inserted. In this context, in the regions of its two end sections 4 as well as in the region of the summit of its curvature, wiper blade 1 is supported on container 2. In the region of end section 4, since wiper lip 8 is situated lying outwards, there is the danger, when wiper blade 1 stretches, that wiper lip 8 may be damaged. In the area of the summit of the curvature, the supporting is able to take place, for example, via adapter 14, i.e. via wiper blade 1 itself. To avoid damage to wiper lip 8, however, at least the two end sections 4 of wiper blade 1 are each connected to an insert 3 before insertion. Each insert 3 has a plurality of accommodation regions 5, 7, 17. A first accommodation region 5 is adapted to the shape of elastic carrier element 6, so that after the insertion of wiper blade 1, form-locking and, at the same time position fixing of wiper blade 1 are effected. A second accommodation region 7, that is adjacent to first accommodation region 5, is used to accommodate wiper lip 8, and is oversized compared to the dimensions of wiper lip 8, so that the latter is able to be accommodated freely and unstressed. On the side lying opposite second accommodation region 7, an additional accommodation region 17 is adjacent to first accommodation region 5, in the exemplary embodiment shown in FIGS. 3 and 4. This accommodation region 17 may be used, for example, for accommodating a spoiler 15 or another additional element of wiper blade 1. In order to simplify the development of the various accommodation regions 5, 7, 17, the production of the insert from plastic by deep drawing is provided.

As may be seen in FIGS. 3 and 4, the insert shown has an upper part 3.1 and a lower part 3.2, which are connected in one piece via a film hinge 12. Film hinge 12 makes possible bringing together the two parts 3.1, 3.2, in order to connect these to each other after the insertion of wiper blade 1 into one of parts 3.1, 3.2. To produce the connection, the two parts 3.1, 3.2 have connecting arrangements 10, 11. Connecting arrangement 10 of upper part 3.1 is developed in this instance as a latch, and connecting arrangement 11 of lower part 3.2 is developed in this instance as a recess, latch and recess cooperating in a latching manner. When a deep drawing method is used, connecting arrangements 10, 11 are able to be produced at the same time with insert 3.

In the exemplary embodiment of an insert 3, shown in FIGS. 3 and 4, overall length L=110 mm, width B=40 mm and height H=10 mm. In each case, the dimensions have to be adjusted to the dimensions of wiper blade 1. Furthermore, in such an insert, a plurality of wiper blades may also be accommodated. In this case, the overall length L is to be selected correspondingly longer.

According to one modification of the present invention that is not shown, inserts 3 may also be developed in such a way that they do not completely encompass the respective end section 4 of a wiper blade 1 that is to be accommodated. For example, inserts 3 may be developed in the type of a shoe, which is pushed onto the end section 4 of wiper blade 1 starting from the end face. For the protection of sensitive wiping edge 9, it is sufficient that insert 3 at least partially encompasses wiper lip 8. In order to effect form-locking in the direction of curvature of wiper blade 1 for the purpose of position fixing, an insert 3 only partially encompassing wiper lip 8 has at least two crosspiece-like elements which are developed on two opposite sides of insert 3, and which, during the pushing on of insert 3 to wiper blade 1, each engage in a profiling groove of wiper lip 8 or wiper blade 1, respectively. At the same time, the insert has an accommodation region 7, for accommodating wiper lip 8, which is dimensioned so that at least sensitive wiper edge 9 of wiper lip 8 lies exposed.

What is claimed is:

1. A device for packaging a wiper blade for a windshield wiping system of a motor vehicle, comprising:

a flexurally stiff container;

at least two inserts able to be inserted into the container together with the wiper blade, the at least two inserts having mirror symmetry and for accommodating in each case an end section of the wiper blade, each insert having at least one accommodation region for accommodating a wiper lip of the wiper blade, wherein:

the accommodation region provided for accommodating the wiper lip is oversized compared to dimensions of the wiper lip, so that the wiper lip is able to be accommodated in such a way that a sensitive wiping edge of the wiper lip has no contact with the insert, and the inserts each include an upper part and a lower part, wherein, with respect to each of the inserts, the upper part of a respective insert is connectable to the lower part of the respective insert in at least one of a force-locking manner and a form-locking manner, wherein the upper part and the lower part are connected in a hinged manner.

2. The device as recited in claim 1, wherein each insert has at least one further accommodation region for accommodating a spring-elastic carrier element.

3. The device as recited in claim 2, wherein the further accommodation region, provided for accommodating the spring-elastic carrier element, of an insert in the form of the spring-elastic carrier element is adapted, in the region of the end section of the wiper blade that is to be accommodated, so that by inserting the wiper blade, form-locking is able to be effected in at least one direction.

4. The device as recited in claim 1, wherein the upper part and the lower part each has at least one connecting arrangement for the at least one of the force-locking connection and the form-locking connection.

5. The device as recited in claim 1, wherein the inserts are at least one of made of a plastic and produced by a deep drawing method.

6. The device as recited in claim 1, wherein the container is developed as one or more pieces and is made of at least one of a plastic and a cardboard.

7. The device as recited in claim 1, wherein the container is one of open and able to be opened at at least one of an end face and a longitudinal side for inserting the wiper blade inclusive of the inserts.

8. A device for packaging a wiper blade for a windshield wiping system of a motor vehicle, comprising:

a flexurally stiff container;

at least two inserts able to be inserted into the container together with the wiper blade, the at least two inserts having mirror symmetry and for accommodating in each case an end section of the wiper blade, each insert having at least one accommodation region for accommodating a wiper lip of the wiper blade, wherein:

the accommodation region provided for accommodating the wiper lip is oversized compared to dimensions of the wiper lip, so that the wiper lip is able to be accommodated in such a way that a sensitive wiping edge of the wiper lip has no contact with the insert, and the inserts each include an upper part and a lower part, wherein, with respect to each of the inserts, the upper part of a respective insert is connectable to the lower part of the respective insert in at least one of a force-locking manner and a form-locking manner, wherein the upper part and the lower part are developed as one piece.

* * * * *